US005856627A

United States Patent [19]

George

[11] Patent Number: 5,856,627

[45] Date of Patent: Jan. 5, 1999

[54] THUMB MOUNTED STRIKING DEVICE FOR STRINGED MUSICAL INSTRUMENTS

[76] Inventor: Michael George, 6422 Montgomery Ave., Van Nuys, Calif.

[21] Appl. No.: 551,335

[22] Filed: Nov. 1, 1995

[51] Int. Cl.[6] ..... G10D 3/16

[52] U.S. Cl. ..... 84/322

[58] Field of Search ..... 84/322

[56] References Cited

U.S. PATENT DOCUMENTS

| | | | |
|---|---|---|---|
| D. 291,809 | 9/1987 | Jasper | D17/20 |
| 3,442,169 | 10/1967 | Bowers | 84/322 |
| 4,020,732 | 5/1977 | Kelly | 84/322 |
| 4,102,234 | 7/1978 | Brundage | 84/322 |
| 4,270,433 | 6/1981 | Ademic | 84/322 |

*Primary Examiner*—Patrick J. Stanzione
*Attorney, Agent, or Firm*—Marc Steven Colen

[57] ABSTRACT

A thumb mounted striking device is for use on stringed musical instruments, particularly electric bass guitars, whereby the striking mechanism is attached to and rendered integral with said ring element which is placed upon the thumb. The striking mechanism projects outwardly and is nominally flat, with the planar striking surface having an axis parallel to the axis of the thumb and an axis tangential to and normal to the axis of the thumb. Its attachment to the ring element is at the outward portion of the ring when said ring is placed upon the thumb.

10 Claims, 2 Drawing Sheets

THUMB MOUNTED STRIKING DEVICE FOR STRINGED MUSICAL INSTRUMENTS

REFERENCES CITED

| U.S. Patent Documents | | | |
|---|---|---|---|
| 4,270,433 | 2 June 1981 | Adamec | 84/322 |
| 4,625,616 | 2 Dec. 1986 | McVicker | 84/322 |
| 4,867,032 | 19 Sept. 1989 | Lukehart | 84/322 |

BACKGROUND

1. Field of Invention

While intended for use on all stringed instruments, the invention may find its greatest use on the electric bass guitar. The electric bass guitar was conceived of by Mr. C. L. Fender, with Design Pat. No. 169,062 issuing Mar. 24, 1953. Since that time, various techniques previously used on conventional steel and nylon steel guitars as well as techniques used on the acoustic upright double bass have been used to cause the strings to vibrate, which vibration induces a signal in the electrical pickup devices of the instrument, which signal is then amplified electronically and returned to vibrational mechanical energy by means of loudspeakers.

These techniques used to cause the strings to vibrate have included plucking using fingers and/or thumb or the use of a pick held between the thumb and a finger, all of which induce a string vibration parallel to the plane of the fingerboard of the instrument.

More recently, a technique has been developed in which the string is impacted using the side of a thumb in a direction normal to that of the plane of the fingerboard bouncing off of the fingerboard and thus inducing a string vibration normal to the fingerboard of the instrument. This technique may incidentally use the fingers to pluck the strings also in a direction normal to that of the plane of the fingerboard and thus intended to induce a vibration normal to the fingerboard of the instrument.

This invention relates to a device intended to be worn on the proximal and/or distal phalanx of the thumb which permits the striking of the string by a rigid material inducing vibrations normal to that of the body surface of the instrument which vibrations are not damped by the soft tissue of the human thumb. In addition, this invention serves to protect the sensitive thumb joint and also serves as an aid in the instruction of thumb impact technique.

2. Prior Art

The prior art consists of picks or plectrums used to induce vibrations in a direction parallel to the plane of the fingerboard of the instrument and the striking the string with the side of the thumb, inducing vibrations normal to that of the body surface of the instrument.

The major disadvantage of the use of a pick or plectrum is that said devices cannot induce the requisite direction of string vibration normal to that of the body surface of the instrument.

The major disadvantages of the present system of using the thumb are signal [vibration] damping, low level of high order harmonics, low output levels and the potential for damage to the joint between the proximal and distal phalanx of the thumb from repeated impacts, which may be hundreds of times per minute and thousands of times per playing session.

OBJECTS AND ADVANTAGES

It is the objective of this invention to provide a thumb mounted striking device intended to be worn on the proximal and/or distal phalanx of the thumb which permits the striking of the string of a stringed musical instrument by a rigid material inducing vibrations normal to that of the body surface of the instrument which vibrations are not damped by the soft tissue of the human thumb. By doing so, the resultant vibrations are not damped and therefore contain a much larger degree of higher harmonics, which leads to a highly desirable sound quality and to a significantly larger acoustic volume and electrical [pickup] output.

It is a further objective of this invention to provide a thumb mounted striking device that, as a result of its being constructed of a material far harder than human skin and tissue, permits the transference of greater energy from the thumb to the string and thus requiring less motion of the hand and thumb.

It is another objective of this invention to provide the device as aforesaid which protects the finger itself from repeated impact on the joint between the proximal and distal phalanx of the thumb.

It is an additional objective of this invention to provide the device as aforesaid which serves as an aid in the instruction of thumb impact technique.

Further objects and advantages of my invention will become apparent from consideration of the drawings and ensuing description of my invention.

SUMMARY OF INVENTION

My invention is a thumb mounted striking device to be worn on the proximal phalanx, distal phalanx, and/or the joint between the proximal and distal phalanx of the thumb and is used to the strike the string of a stringed instrument, particularly an electric bass guitar, by a rigid material inducing vibrations normal to that of the body surface of the instrument which vibrations are not damped by the soft tissue of the human thumb. This leads to a highly desirable sound quality, significantly larger acoustic volume and electrical [pickup] output, protects the thumb itself and aids in the teaching of the thumb impact technique.

DESCRIPTION OF STRUCTURE OF INVENTION

DESCRIPTION OF THE PREFERRED EMBODIMENTS

Figure 1:
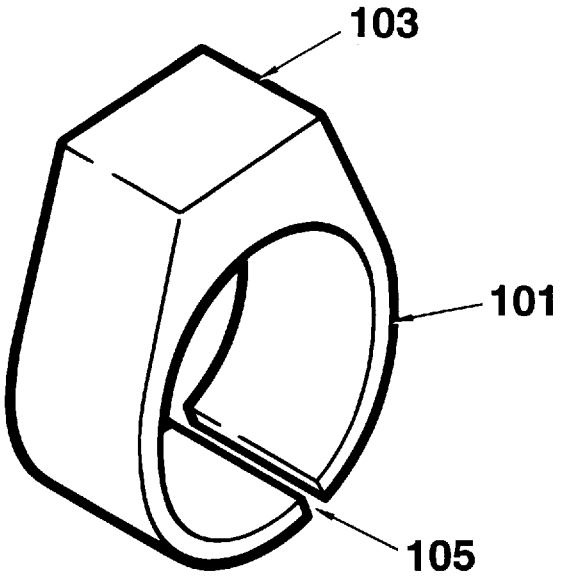
FIG. 1 is a perspective view of the thumb mounted striking device to illustrate the specific elements thereon.

FIG. 1 illustrates one preferred embodiment of my invention. The form of the thumb mounted striking device with a ring portion 101 generally oval in cross section and tubular in shape into which the thumb is inserted and impacting surface 103. The length of the ring section is such that it provides stability upon the thumb while being comfortable to the musician. The ring section may be discontinuous with a gap provided to permit more ready conformance to the size of the thumb, with an appropriate discontinuity shown as 105. The angle of the impacting surface is nominally tangential to the ring ±30 degrees. The shape of the impacting surface is nominally flat or it may have a convex radius.

Figure 2:
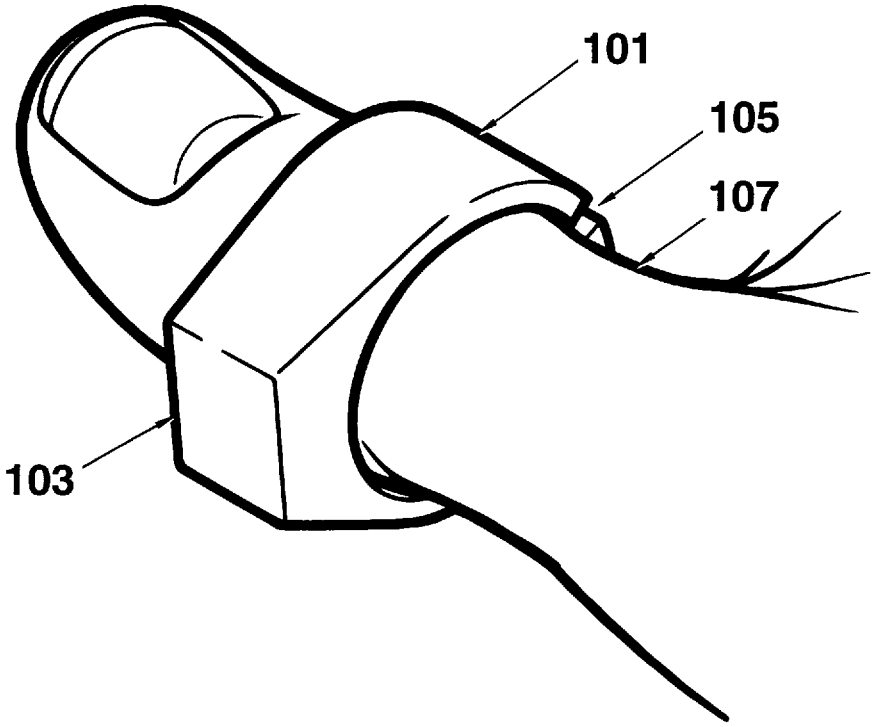
FIG. 2 is a perspective view of the thumb mounted striking device as installed on a user's thumb.

FIG. 2 illustrates a preferred embodiment of my invention when it correctly positioned on a thumb 107.

Figure 3:
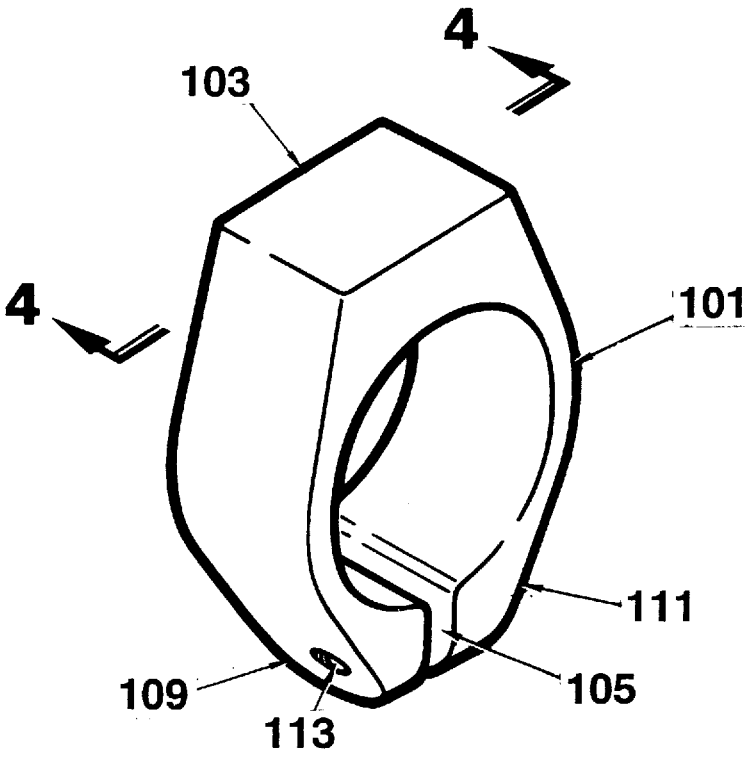
FIG. 3 is a perspective view of the thumb mounted striking device to illustrate an alternate embodiment of the invention.
Figure 4:
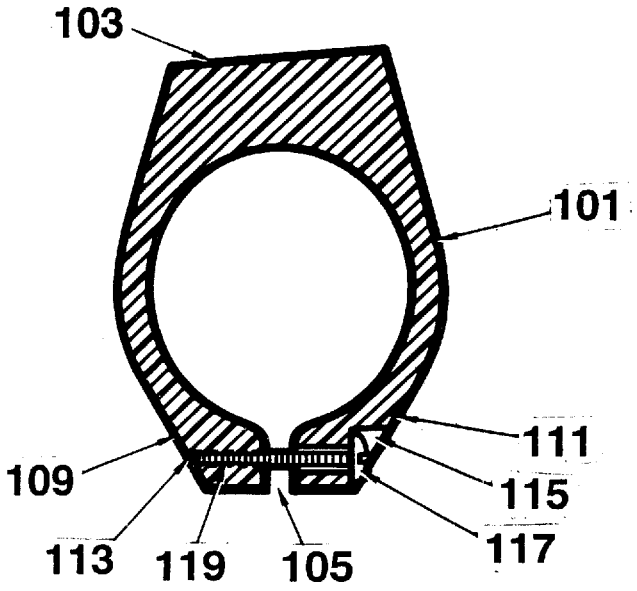
FIG. 4 is a cross-sectional view through plane A—A of FIG. 3.

FIG. 3 illustrates another embodiment of my invention in which the discontinuity is adjustable. Ears 109 and 111 of said ring 101 are nominally radial to the ring and at least 90 degrees from said striking surface 103. Through holes in said ears 109 and 111 are holes 113 and 115 into which are inserted an externally threaded member 117, which threaded member mates with the internal threads 119 of lip 109.

The material of said ring 101 may be metallic, polymeric or organic, i.e., wood, so long as it has the requisite mechanical strength and elasticity limit to permit its being placed on and removed from the thumb while maintaining mechanical integrity and configuration. The material of said striking surface 103 may be metallic, polymeric, ceramic or organic, so long as it has the requisite mechanical strength and elasticity limit to permit its being repeated struck against the strings while maintaining mechanical integrity and configuration. Further, the selection of the particular material to be used on said striking surface 103 is a function of, among other things, the desired sound to be produced by the musician.

Although this description contains certain specifications and details, these should not be construed as limitations upon the scope of my invention. Rather, they should be considered as an exemplification of one preferred embodiment thereof. For example, the adjustment device and the ring gap may be omitted in the event that a thumb mounted striking device is custom fit for a particular person. As a further example, the ring portion is elliptical or circular rather than oval in cross section. As another example, there may be more than one impacting surface, of possibly different configurations or materials, so that by rotating the ring upon the thumb, an alternate striking surface is brought to bear which surface may create a somewhat different sound. In this case, the ring is nominally round.

Alternate Forms

As noted above, there are alternate configurations possible for the ring portion, the locking portion and striking surface. My invention is not limited to the form above described and delineated; rather the scope of my invention should be determined not merely by the embodiments illustrated, but rather by the appended claims and their legal equivalents.

Explanation of Invention Operation

The thumb mounted striking device is placed onto the thumb, particularly onto the proximal and/or distal phalanx of the thumb such that the impacting surface is generally toward the palmar surface of the hand. Adjustment of the thumb mounted striking device is made so that the unit is snug around the thumb. The degree of tightness is to a large degree related to the preferences of the player, but it must be sufficiently tight that it does not rotate out of position but not so tight that it restrains blood flow and lymphatic fluid flow within the thumb. Aiding in the maintenance of proper orientation is the nominally oval shaped cross-section of the ring.

The hand is placed in the conventional region of the musical instrument, particularly an electric bass guitar, and the hand is rotated in an axis generally that of the forearm. By way of this rotation, the impacting surface of the thumb mounted striking device is caused to impact the particular string at which the thumb mounted striking device is aimed and in a direction generally normal to the surface of the guitar body. The impact on the string should be of a low time duration; thus the string is struck in a bouncing motion. Inasmuch as the impacting portion of the thumb mounted striking device is made of a non-damping material, high order vibrations are generated along with the lower order vibrations. The string may bounce off of the fingerboard after the impact with the thumb mounted striking device.

Conclusions

Invention Advantages

Thus it can be seen that the thumb mounted striking device of my invention provides a device worn on the proximal and/or distal phalanx of the thumb permitting the striking of the string of an electric bass guitar by a rigid material inducing vibrations normal to that of the body surface of the instrument, which vibrations are not damped and therefore contain a much larger degree of higher harmonics, a highly desirable sound quality and significantly larger acoustic volume and electrical [pickup] output.

I claim:

1. A thumb mounted striking device to be used to impact a string of a stringed instrument in order to induce string vibrations primarily in the direction perpendicular to the fingerboard of such a stringed instrument, comprising a tubular ring of material, the external perimeter of said ring having an integral striking surface nominally tangential to said ring, said striking surface being smaller than the outside diameter of said ring and the center of said striking face being radial to the ring.

2. The thumb mounted striking device of claim 1 wherein said ring has a means for adjusting the inner diameter of the ring.

3. The thumb mounted striking device of claim 1 wherein the device is made of a polymer.

4. The thumb mounted striking device of claim 1 wherein the ring portion and the striking surface(s) are not comprised of the same material.

5. The thumb mounted striking device of claim 1 wherein the ring portion is made of a polymer and the striking surface is made of metal.

6. A thumb mounted striking device to be used to impact a string of a stringed instrument in order to induce string vibrations primarily in the direction perpendicular to the fingerboard of such a stringed instrument, comprising a tubular ring of material, the external perimeter of said ring having an integral striking surface on said ring, said striking surface being smaller than the outside diameter of said ring, the center of said striking face being radial to said ring, and the angle of said striking surface is nominally tangential to the ring ±30 degrees.

7. The thumb mounted striking device of claim 6 wherein said ring has a means for adjusting the inner diameter of the ring.

8. The thumb mounted striking device of claim 6 wherein the device is made of a polymer.

9. The thumb mounted striking device of claim 6 wherein the ring portion and the striking surface(s) are not comprised of the same material.

10. The thumb mounted striking device of claim 6 wherein the ring portion is made of a polymer and the striking surface is made of metal.

* * * * *